US005810100A

United States Patent [19]

Samford

[11] Patent Number: 5,810,100

[45] Date of Patent: Sep. 22, 1998

[54] NON-ROTATING STABILIZER AND CENTRALIZER FOR WELL DRILLING OPERATIONS

[75] Inventor: Travis L. Samford, Spring, Tex.

[73] Assignee: Founders International, Houston, Tex.

[21] Appl. No.: 740,791

[22] Filed: Nov. 1, 1996

[51] Int. Cl.[6] ..... E21B 17/10

[52] U.S. Cl. ..... 175/325.3; 166/241.3; 166/241.6; 175/325.7

[58] Field of Search ..... 175/325.3, 325.7, 175/325.2; 166/241.3, 241.4, 241.1, 241.5, 241.6

[56] References Cited

U.S. PATENT DOCUMENTS

| | | | |
|---|---|---|---|
| 1,985,229 | 12/1934 | Allen | 175/325.3 |
| 2,368,415 | 1/1945 | Grant | 175/325.7 |
| 2,696,367 | 12/1954 | Robishaw | 175/325.3 |
| 3,104,134 | 9/1963 | Nielsen et al. | 175/325.3 |
| 4,082,373 | 4/1978 | Kellner | 175/325.3 |

FOREIGN PATENT DOCUMENTS

| | | | |
|---|---|---|---|
| 2007543 | 2/1994 | Russian Federation | 175/325.3 |
| 2204895 | 11/1988 | United Kingdom | 175/325.3 |
| 95/05521 | 2/1995 | WIPO | 175/325.3 |

*Primary Examiner*—Hoang C. Dang
*Attorney, Agent, or Firm*—Bush, Riddle & Jackson, L.L.P.

[57] ABSTRACT

A non-rotating stabilizer tool is provided for connection within a drilling string for stabilization and centralization of the drill string within a well bore being drilled by a rotary drill bit. The tool incorporates an elongate stabilizer and centralizer mandrel having upper and lower collars for its connection within the drill string. The mandrel defines an external circumferential stabilizer receptacle having a cylindrical surface and upper and lower shoulders which are lined with a wear resistant low friction material. The mandrel defines a plurality of axially spaced circumferential seat grooves which interrupt the cylindrical receptacle surface and the friction resistant lining. A stabilizer is rotatably mounted within the stabilizer receptacle by a plurality of wear pads that are seated within the circumferential seat grooves and provide rotatable support for the stabilizer with its inner periphery disposed in spaced relation with the lining of the stabilizer receptacle. During normal drilling operations the stabilizer is essentially static within the well bore with the mandrel being rotated within the stabilizer by the drill string. Externally the stabilizer defines helical lands and grooves which define fluid courses, with the lands being provided with a hardfacing material to minimize wear thereof as the stabilizer is moved linearly within the well bore.

15 Claims, 3 Drawing Sheets

NON-ROTATING STABILIZER AND CENTRALIZER FOR WELL DRILLING OPERATIONS

FIELD OF THE INVENTION

This invention relates generally to drilling operations for wells, particularly those wells for production of petroleum products. More particularly, the present invention relates to a non-rotating stabilizer tool for connection in a well drilling string stabilization and centralization of the drill string during rotary drilling operations.

BACKGROUND OF THE INVENTION

For many years, a majority of the well drilling operations for production of petroleum products has been conducted by rotating an interconnected series of drill pipe sections known in the industry as a drill string, and accomplishing rotary engagement of an earth formation with a drill bit connected to the lower end of the drill string. As the drill string is rotated, a drilling fluid known as drilling mud is pumped at sufficient pressure through the drill string so that it exits the drill string at the drill bit and provides for lubrication and cooling of the drill bit as well as serving to flush drill cuttings away from the drill bit. The drilling fluid, which is laden with drill cuttings flushed away from the drill bit will then flow upwardly, through the annulus between the drill string and the well bore being drilled and through the annulus between the drill string and well casing lining the well bore to the surface. At the surface the drilling fluid is processed for cleaning, such as by vibratory screens and other cleaning devices and, after having been prepared for reuse, is again pumped into the drill string for recirculation through the drill bit and well bore.

As the drill string is rotated within the well bore it will often wobble and become decentralized within the well bore, thus causing directional errors of the well bore being drilled, causing the dimension of the well bore to be erratic and developing unusual forces on the drilling bit that can accelerate wear of the bit. Wobbling of the drilling string can also enhance the development of undercut well bore areas known as "key seats" and, due to contact between the drill string and the well bore wall during rotation of the drill string, can cause accelerated wear of the drill string. The wobbling activity can also develop cyclical force reversals, i.e., compression and tension, which can cause accelerated failure of the drill string by metal fatigue. Drill string wobbling and contact of the drill string with the formation during drilling can be overcome by providing means for centralizing the drill string within the well bore.

Since it is desirable in many cases to insure that a rotary drill bit is centralized with respect to the well bore being drilled, centralizer tools having contact elements only slightly smaller in diameter as compared with the diameter of the well bore are connected into the drill string and function to engage the wall of the well bore in the event the drill string should become slightly decentralized. These centralizer tools are typically elongate objects provided with upper and lower box and pin thread connections so that they may be connected by threading to adjacent drill stem sections. The stabilizer or centralizer element of the tool is typically defined by an enlarged tool section having a plurality of helical lands or flutes for borehole wall contact which rotate along with the drill string. The helical grooves of the centralizer define flow passages for conducting past the stabilizer drilling fluid and drill cuttings flowing upwardly through the annulus between the drill string and well bore wall to the surface under the influence of pump generated pressure. The helical flutes or lands of stabilizers are often times provided with a wear resistant hard facing material to minimize wear thereof by contact with the well bore wall as the drill stem is rotated during well drilling operations. These stabilizers are typically of slightly smaller diameter as compared to the diameter of the drill bit and thus the well bore so that contact of the stabilizer with the well bore wall only occurs under circumstances where the drill string becomes decentralized by an amount exceeding allowable tolerances.

During well drilling operations the drill bit can at times wander laterally causing the bore hole to vary from the vertical or from its intended course. An effective drill string stabilizer will minimize such wandering of the drill bit unless the formation material engaged thereby is sufficiently non-consolidated that the rotating stabilizer will wear away the bore hole wall and permit the drill string to wander or begin to wobble. It is desirable to provide a drill string stabilizing tool which will not wear away the borehole wall during drilling operation and will thus maintain the drill string stabilized and centralized within the well bore and thus assist materially in ensuring that the drill bit will maintain its proper course. Thus it is desirable to provide a drill string stabilizing and centralizing tool having a bore hole wall engaging element that is non-rotatable with respect to the bore hole being drilled and which is rotatable with respect to the drill string.

SUMMARY OF THE INVENTION

It is a principal feature of the present invention to provide a novel non-rotating stabilizer that is connected into a drill string and maintains the drill string centralized within a well bore being drilled.

It is another feature of the present invention to provide a novel non-rotating stabilizer having the capability for establishing a non-rotatable relationship with the wall of the bore hole being drilled and which is disposed in rotatable relation with the drill string.

It is also a feature of the present invention to provide a novel non-rotating stabilizer which has a tubular mandrel for connection within and for rotation with a drill string and employs a bore hole wall contact stabilizer and centralizer element having relatively rotatable support by the tubular mandrel.

It is an even further feature of the present invention to provide a novel non-rotating stabilizer tool having a mandrel for connection within a rotary drill string and which has a bore hole wall contact element which is supported on the mandrel for relative rotation therewith by a wear resistant rotary connection.

It is among the several features of this invention to provide a novel non-rotating stabilizer tool having a mandrel for connection within a rotary drill string and having a bore hole wall contact stabilizer and centralizer element which is supported on the mandrel for relative rotation therewith by means of bearing that minimize the resistance of the stabilizer element to rotational torque as the mandrel is rotated relative to the stabilizer by the rotating drill string.

It is also a feature of the present invention to provide a novel non-rotating stabilizer which has a tubular mandrel for connection within and for rotation with a drill string and employs a bore hole wall contact stabilizer and centralizer element having relatively rotatable support by the tubular mandrel.

It is also a feature of the present invention to provide a novel non-rotating stabilizer which has a tubular mandrel for connection within and for rotation with a drill string and employs a bore hole wall contact stabilizer and centralizer element which is restrained by the mandrel structure against axial motion relative to the tubular mandrel.

Briefly, the various objects and features of the present invention are realized by a non-rotating stabilizer tool having an elongate tubular mandrel having drill collars at the upper and lower ends thereof for threaded connection of the tool between sections of drill stem making up the drill string of the well drilling equipment. Between the drill collars the mandrel defines an elongate, generally cylindrical tubular section having a longitudinal passage therein for conducting the flow of drilling fluid therethrough. The elongate tubular mandrel defines a reduced diameter intermediate section having upper and lower thrust shoulders. The reduced diameter intermediate section and the upper and lower thrust shoulders are lined with a wear resistant material such as aluminum/bronze, for example, which may be applied to the selected surfaces by a brazing operation. Bearing means in the form of friction resistant wear pads are also provided at axially spaced locations on the reduced diameter intermediate section to provide support for a generally tubular split stabilizer and centralizer element which is secured about the reduced diameter intermediate tubular section of the mandrel and is rotatably mounted on the mandrel. The reduced diameter intermediate tubular section is of generally cylindrical configuration so that the stabilizer and centralizer element can remain in non-rotatable relation with the well bore without interference with rotation of the mandrel by the drill string. Stabilizer body sections, which may each be generally semi-cylindrical stabilizer body halves if desired, are secured in assembly about the reduced diameter intermediate section of the mandrel by bolts or other suitable retainer devices. The wear pads are composed of any suitable friction resistant material such as polytetrafluoroethylene (PTFE) or any of a number of suitable friction resistant polymer materials or any combination of such friction resistant materials with other suitable materials to thus ensure freely rotatable mounting of the stabilizer on the mandrel. The friction and wear resistant material of the wear pads must also be suitable for use in the downhole environment and must be resistant to the erosive effects of drilling fluid being used in the well drilling operation. The stabilizer defines external helical lands and grooves, with the grooves serving as flow passages for drilling fluid and with the lands serving as contact elements for stabilizing and centralizing engagement with the wall of the bore hole being drilled. The lands may be provided with any suitable hardfacing material for wear resistance to minimize the wear that can occur as the stabilizer is moved along the wall surface of the well bore being drilled.

This tool is therefore useful to stabilize and centralize the drill string to ensure optimum controlled drilling of a well bore.

DETAILED DESCRIPTION OF PREFERRED EMBODIMENT

Figure 1:
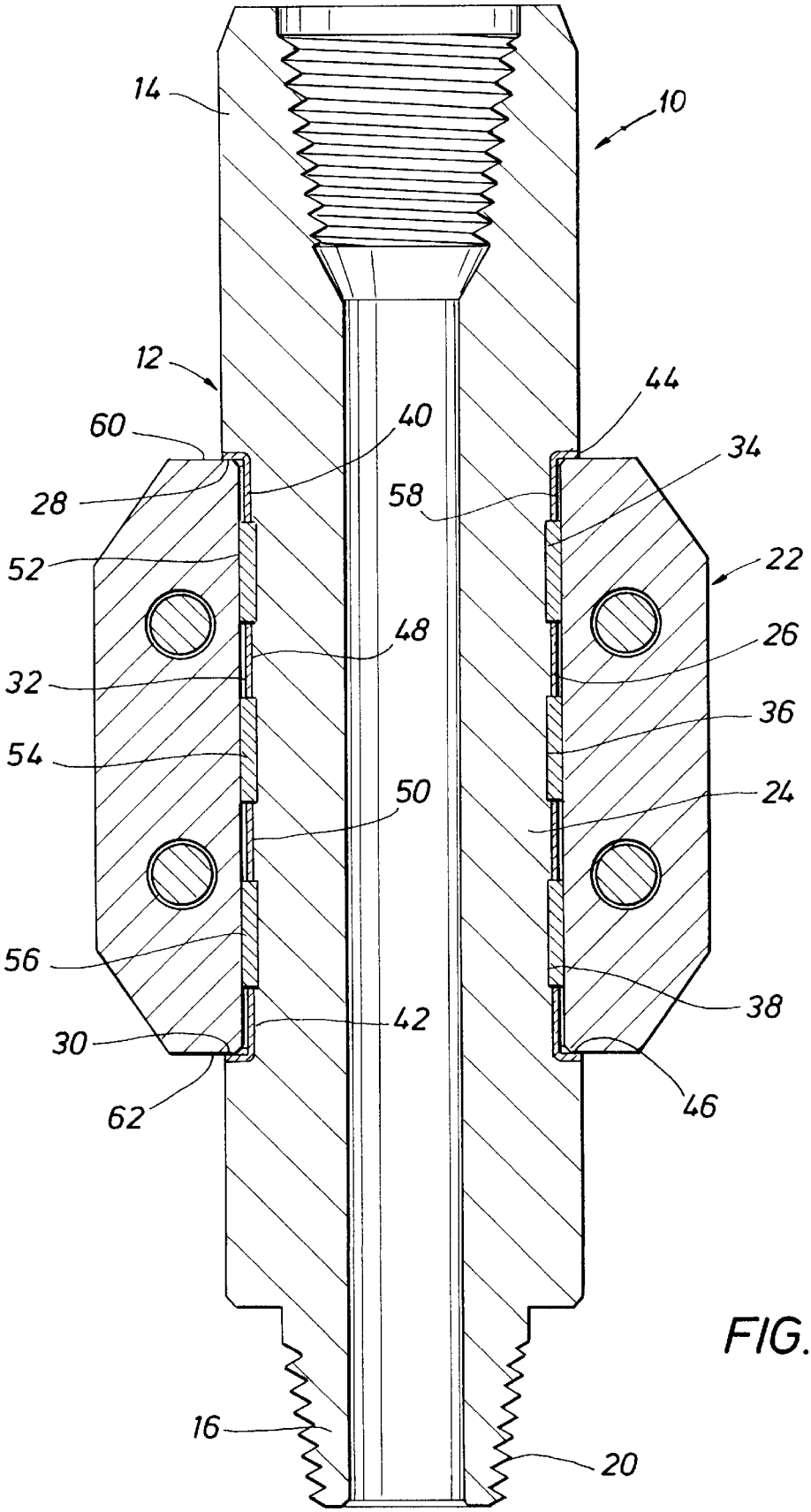
FIG. 1 is a longitudinal sectional view of a non-rotating drill stem stabilizer and centralizer tool that is constructed in accordance with the present invention and represents the preferred embodiment thereof.
Figure 2:
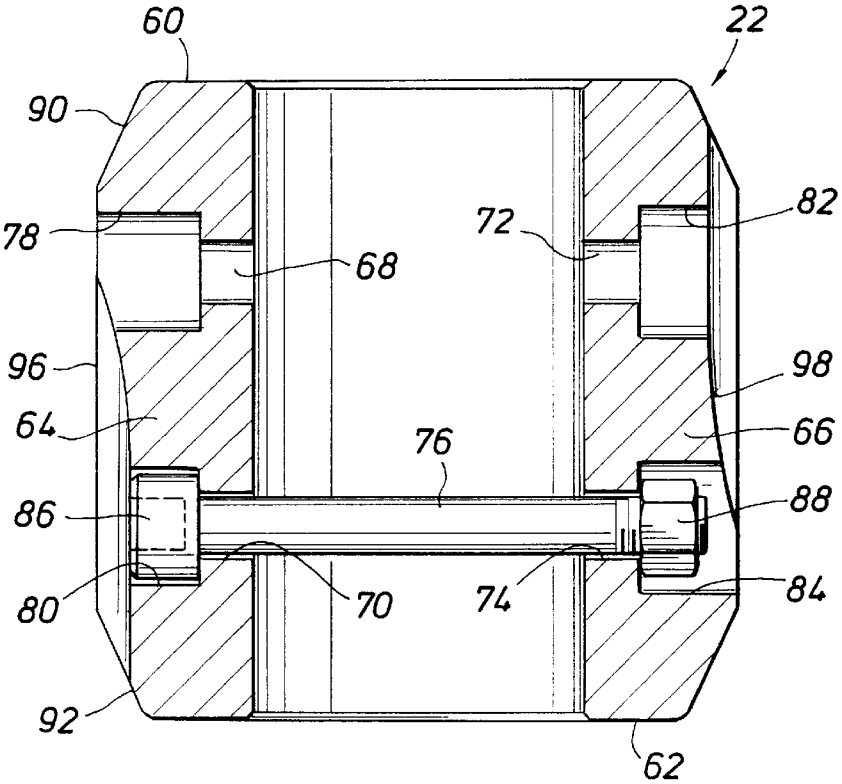
FIG. 2 is a sectional view of the stabilizer and centralizer element of the non-rotating drill stem stabilizer and centralizer tool of FIG. 1.

Referring now to the drawings and first to FIGS. 1 and 2, a non-rotating stabilizer constructed in accordance with the present invention is shown generally at 10 and incorporates an elongate tool mandrel shown generally at 12. For connection of the tool to a drill string, the mandrel 12 is provided with upper and lower drill collar sections 14 and 16 each defining conventional thread connections. The upper drill collar section 14 is a typical "box" connection having internal threads 18 for receiving the lower externally threaded "pin" connection of a section of drill stem. Likewise, the lower drill collar section 16 of the elongate mandrel is provided with a conventional externally threaded tapered pin connection 20 which is received by the internally threaded box connection at the upper end of a lower section of drill stem defining a section of the drill ring. The mandrel 12 thus becomes an integral, rotary and linear force-transmitting component of the drill string having a lower end to which a drill bit is connected for drilling into the earth formation upon rotation of the drill string by a drilling rig.

It is desirable in many cases to provide a drill string with one or more stabilizers or centralizes which may come into engagement with the wall of the well bore being drilled to centralize the drill string with respect to the well bore. Since rotary contact of a stabilizer with the well bore wall during drill string rotation is generally considered undesirable, the stabilizer should be rotatable with respect to the mandrel so that it will be essentially static within the well bore wall as the drill string and thus also the mandrel is rotated during well drilling activity. These desirable features are provided in the preferred embodiment by a stabilizer and centralizer element, shown generally at 22, which is positioned about an elongate generally cylindrical reduced diameter section 24 of the mandrel for relative rotation with respect thereto.

The reduced diameter section 24 of the tubular mandrel 12 is machined so as to define a cylindrical surface 26 having the respective upper and lower ends thereof disposed in intersecting relation with upper and lower shoulders 28 and 30 that are oriented radially and are disposed in substantially normal relation with the cylindrical surface. The cylindrical reduced diameter surface and the upper and lower shoulders cooperatively define an elongate circumferential stabilizer receptacle within which the stabilizer and centralizer element is rotatably mounted. The cylindrical surface and radial shoulders of the stabilizer receptacle are lined with a friction and wear resistant material 32 which may conveniently take the form of an aluminum/bronze composition that is brazed or otherwise attached to the appropriate surfaces. It should be borne in mind that a number of other suitable wear resistant materials may also be utilized for the friction and wear resistant lining of the stabilizer receptacle.

In use, with one or more of the non-rotating stabilizer assemblies positioned within a drill string, drilling operations continue with the stabilizer maintaining the drill string in centralized relation within the bore hole being drilled. Stabilization or centralization of the drill string in this manner helps ensure the drilling of a straight bore hole since wobbling or lateral hunting of the drill string is held to a minimum.

The wear resistant lining 32 which is disposed about the generally cylindrical outer surface section 26 of the mandrel 12 is divided into a plurality of linear segments by circular grooves 34, 36 and 38 so that upper and lower sections 40 and 42 of the lining also define generally planer, circular lining shoulders 44 and 46, respectively between the upper and lower lining sections 40 and 42, the intermediate grooves define generally cylindrical lining sections 48 and 50. Within the respective circular grooves 34, 36 and 38 are located spaced, circular wear pads 52, 54 and 56 that are composed of any suitable wear resistant material that also has friction resistant characteristics. For example, the wear pads 52, 54 and 56 may be composed of PTFE or any one of a number of suitable wear resistant polymer materials or composites of polymer materials with other wear and friction resistant materials. These wear pads are seated within the respective wear pad grooves 34, 36 and 38 and project radially beyond the outer surface of the wear resistant lining 32 so that the interior surface 58 of the stabilizer 22 is disposed in slightly spaced relation with respect to the wear resistant lining 32 as shown in FIG. 1. In practice, the internal surface 58 of the stabilizer becomes seized with respect to the wear pads so that there is little tendency for the stabilizer to move axially with respect to the mandrel. Thus, unless unusual actual forces are encountered, the upper and lower ends 60 and 62 of the stabilizer and centralizer element 22 will be disposed in slightly spaced relation with the circular lining sections 44 and 46.

For assembly of the stabilizer 22 about the mandrel 12, the stabilizer is separated into generally semi-cylindrical stabilizer sections or halves 64 and 66 as best shown in FIG. 2. Stabilizer half 64 defines upper and lower bolt holes 68 and 70 which, when the stabilizer halves are in assembly are disposed in registry with corresponding bolt holes 72 and 74 of stabilizer half 66. Retainer bolts such as shown at 76 in FIG. 2 are placed in the respective bolt holes such as shown in FIG. 2. The bolt holes 68 and 70 define enlarged outer sections 78 and 80 respectively, while bolt holes 72 and 74 define enlarged outer sections 82 and 84. The bolts 76 are positioned so that bolt heads 86 are received within respective bolt hole enlargements and lock nuts 88 are received within other bolt hole enlargements such as shown at 84 in FIG. 2. The bolt head enlargements 84 are of sufficient diameter with respect to the nuts 88 so that a socket wrench may be used to secure the retainer nuts of the bolts or cap screws to thus retainer the stabilizer sections in assembly about the intermediate, generally cylindrical portion 26 of the mandrel. The bolt hole enlargements are also of sufficient dimension and depth so that the respective head and retainer nut of the bolts or cap screws will be recessed below the depth of the helical grooves of the outer portion of the stabilizer element. As shown by broken lines, in FIG. 2 and by full lines in FIG. 3, the stabilizer element 22 defines upper and lower tapered shoulder surfaces 90 and 92 respectively which have intersection with outer cylindrical surface portions 94 of the stabilizer which are defined by a plurality of helical lands 96 which are separated by helical groove sections 98. The helical grooves serve to conduct the flow of returning drilling fluid past the stabilizer as the drilling fluid flows upwardly through the annulus between the drill stem and the casing or bore hole wall of the well being drilled. The stabilizer element 22 also defines upper and lower circular, generally planer shoulders 60 and 62 as described above in connection with FIG. 1. The helical lands 96, to minimize wear of the stabilizer as it is moved along the vertical extent of the well bore as the drill stem progresses downwardly during drilling operations, are provided with an external hard facing material 100.

Figure 3:
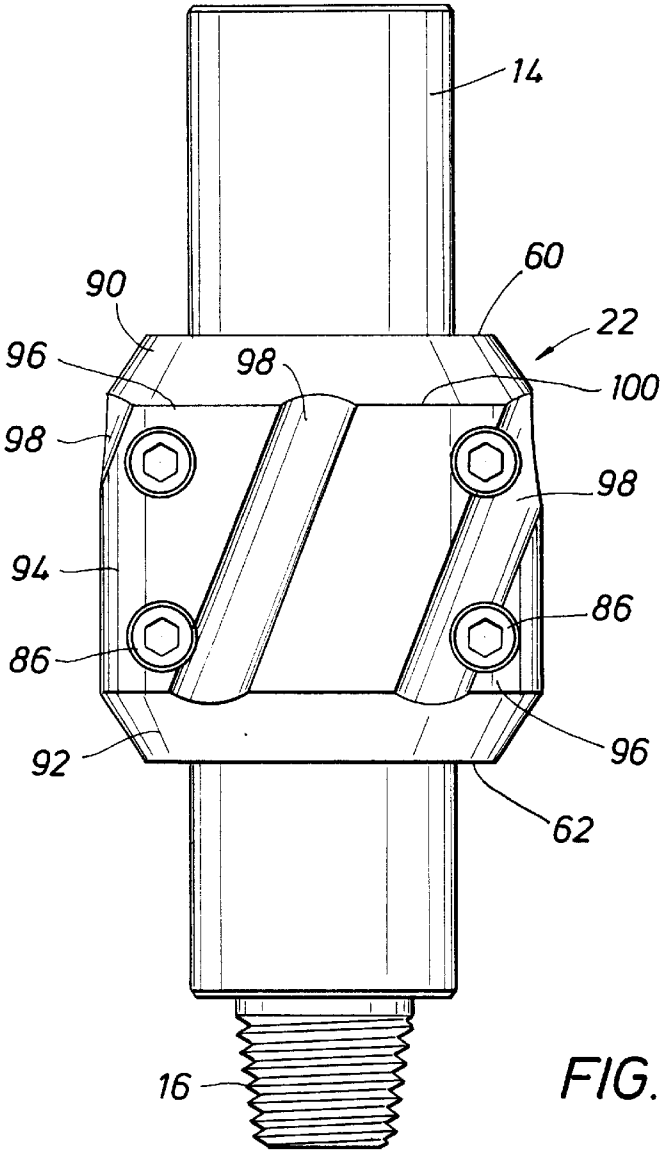
FIG. 3 is an elevational view of the stabilizer and centralizer element of the non-rotating drill stem stabilizer and centralizer tool of FIG. 1.
Figure 5:
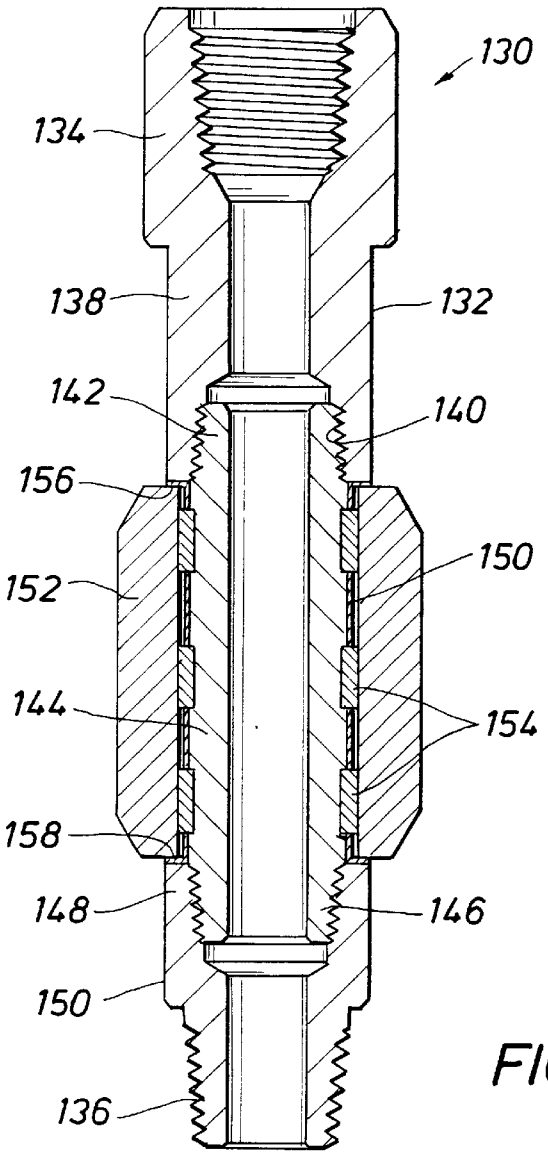
FIGS. 4 and 5 are a sectional views of alternative embodiments of the present invention having an integral stabilizer element and a separable stabilizer mandrel.
Figure 4:
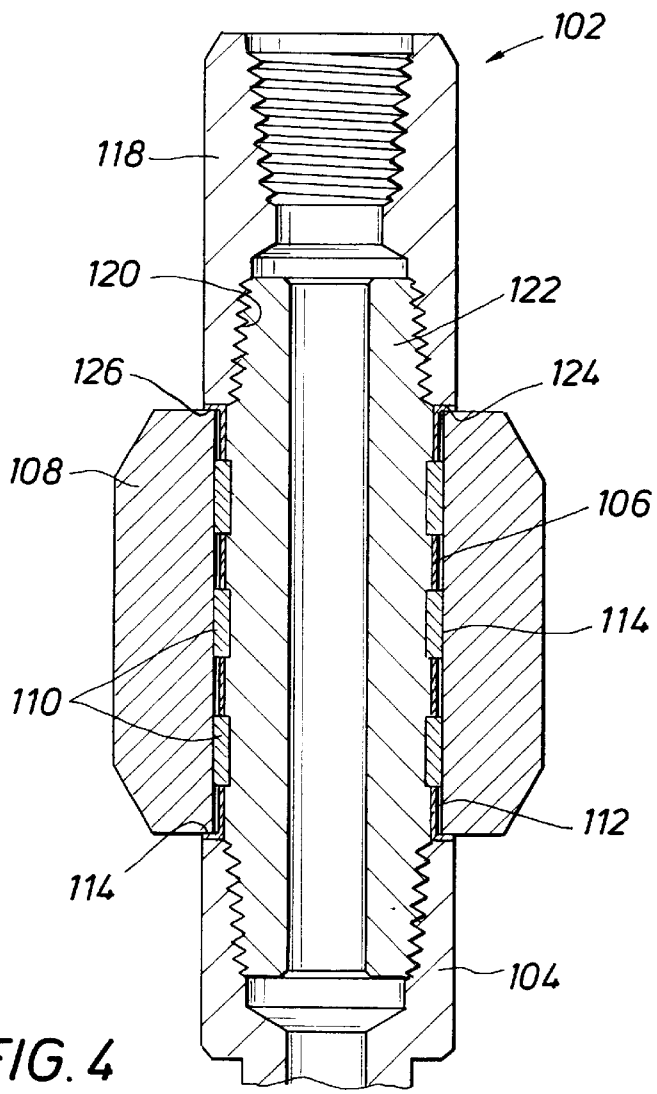

According to the embodiments of FIGS. 4 and 5, within the spirit and scope of this invention the mandrel may be of jointed nature to permit the assembly thereto of a stabilizer element having an integral tubular body rather than the split body construction shown in connection with FIGS. 1-3. As shown in FIG. 4, a stabilizer and centralizer tool is shown generally at 102 and incorporates a tubular body 104 defining a reduced diameter generally cylindrical section 106. An integral tubular stabilizer element 108 is positioned about the reduced diameter tubular section 106 and is mounted for low friction rotation relative thereto by a plurality of spaced wear pads 110 of the same character and purpose as discussed above at 52, 54 and 56. The reduced diameter section is lined for low friction wear resistance by an aluminum/bronze material 112 or other suitable lining such as discussed above in connection with FIG. 32. The lining is segmented by the circular wear pad grooves 114 and is also provided as a lining for the radially oriented, upwardly facing thrust shoulder 116 of the wear pad receptacle. The upper portion of the mandrel 102 is defined by a connection collar 118 having an internally threaded section 120 disposed in connection with an externally threaded upper section 122 of the mandrel body. A downwardly facing shoulder 124 of the connection collar 118 is provided with a low friction lining that may be composed of the same lining material as lining 112. It should be borne in mind that the jointed mandrel body, since it forms a torque and tensile load bearing component of the drill string, must by of sufficient structural integrity that is can safely accommodate the loads of the drill string without breaking and without being damaged during drilling operations.

With reference to FIG. 5, another embodiment of the jointed stabilizer and centralizer tool is shown generally at 130, having a mandrel body 132 having upper and lower connection collars 134 and 136 for threaded connection with adjacent joints of drill stem. Drill collar 134 is defined by a tubular upper mandrel body section 138 having an internally threaded section 140 which is disposed in threaded connection with an externally threaded upper connection section 142 of a central mandrel body section 144. The central body section also defines an externally threaded lower connection 146 which is threadedly connected to the internally threaded upper end 148 of a lower body section 150. The intermediate body section 144 is of reduced outer diameter as compared to the outer diameter of the upper and lower body sections, thereby defining a stabilizer receptacle 150 within which a stabilizer and centralizer element 152 is mounted for low torque, low friction rotation. The stabilizer element 152 is mounted for rotation within the stabilizer receptacle 150 by wear pads 154 and the receptacle is lined with a low friction material in the same manner as discussed above. The upper body section 138 and the lower body section 150 of the mandrel body define respective upper and lower shoulders 156 and 158 which define upper and lower bounds of the stabilizer receptacle. The shoulders are also lined with low friction material in the same manner and for the same purpose as discussed above in connection with reference numeral 32.

From the foregoing, it will be apparent that there has been provided a novel non-rotating stabilizer that is effective for establishing a rather close fit with the wall of the borehole being drilled and thereby enables more accurate centralization of the drill string with the well and thereby provides a more accurate guiding function for the drill bit. Further, when the drill string is being rotated for normal drilling operations the non-rotating stabilizer will be positioned in substantially static relation within the bore hole and will minimize wobbling of the drill string and hunting of the drill bit during drilling operations. It will be seen that certain changes in the present invention may be made without departing from the spirit and scope thereof These changes are contemplated by and within the scope of the invention as defined by the appended claims. It is therefore understood that the embodiments set forth in this specification are to be interpreted in light of the disclosure and claims and are not to taken in any limiting sense. The present embodiment is therefore to be considered as illustrative and not restrictive, the scope of the invention being indicated by the claims rather than the foregoing description, and all changes which come within the range of equivalence of the claims are therefore intended to be embraced therein.

What is claimed is:

1. A non-rotating stabilizer tool for use in well drilling operations, comprising:

(a) an elongate tubular mandrel having an elongate tubular section and upper and lower drill collars for threaded connection to sections of drill stem making up a drill string for rotation of a drill bit against an earth formation for well drilling, said elongate tubular section defining a stabilizer receptacle having a wear and friction resistant lining and having upper and lower receptacle shoulders and defining a wear pad section having a plurality of outer peripheral axially spaced wear pad seats:

(b) a stabilizer element being positioned for rotation about said elongate tubular section and being located within said stabilizer receptacle with portions thereof interposed between said upper and lower receptacle shoulders, said stabilizer element defining external helical lands and grooves to permit flow of returning drilling fluid past said stabilizer element; and (c) a plurality of circular wear pads being located within said plurality of spaced wear pad seats and projecting radially outwardly of said wear and friction resistant lining, said plurality of circular wear pads being interposed between said elongate tubular section and said stabilizer element and defining low friction rotary support for said stabilizer element within said stabilizer receptacle of said elongate tubular section.

2. The non-rotating stabilizer tool of claim 1, wherein:

(a) said elongate tubular section defining upper and lower receptacle shoulders having a wear resistant lining; and (b) said stabilizer element having upper and lower ends being interposed between said upper and lower receptacle shoulders for contact with said wear resistant lining thereof.

3. The non-rotating stabilizer tool of claim 1, wherein:

(a) said elongate tubular mandrel having a generally cylindrical receptacle surface of less outer diameter than the outer diameter of said elongate tubular section;

(b) said upper and lower receptacle shoulders being located at respective extremities of said generally cylindrical receptacle surface; and (c) said plurality of circumferential wear pad seats interrupting said generally cylindrical receptacle surface.

4. The non-rotating stabilizer tool of claim 1, wherein:

(a) said upper and lower drill collars being integral with said elongate tubular section; and (b) said stabilizer element being of split configuration for assembly thereof about said elongate tubular section.

5. The non-rotating stabilizer tool of claim 1, wherein:

(a) at least one of said upper and lower drill collars being threadedly connected to said elongate tubular section; and (b) said stabilizer element being of tubular integral construction and being positioned about said elongate tubular section prior to threaded assembly of said at least one drill collar to said elongate tubular section.

6. The non-rotating stabilizer of claim 1, wherein:

said elongate tubular section having a friction resistant lining.

7. The non-rotating stabilizer of claim 6, wherein:

said friction resistant lining being composed of a material having greater friction resistance as compared to steel.

8. The non-rotating stabilizer of claim 7, wherein:

said friction resistant lining material comprising an aluminum/bronze composition being fixed to said elongate tubular section by thermal application.

9. The non-rotating stabilizer of claim 1, wherein:

(a) said stabilizer receptacle of said elongate tubular mandrel being of cylindrical external configuration and having a defined external diameter and having upper and lower shoulders located at respective upper and lower ends of said elongate generally cylindrical section;

(b) said stabilizer receptacle of said elongate tubular mandrel defining a generally cylindrical external surface having a diameter less than said defined diameter; and (c) said friction resistant lining being composed of an aluminum/bronze composition and being fixed in covering relation with said upper and lower shoulders and said generally cylindrical external surface.

10. The non-rotating stabilizer of claim 9, wherein:

(a) said stabilizer receptacle defining a plurality of spaced circumferential seat grooves interrupting said friction resistant lining; and (b) said plurality of wear pads being seated within said plurality of spaced circumferential seat grooves and having outer surfaces projecting radially outwardly beyond the cylindrical extent of said generally cylindrical external surface.

11. The non-rotating stabilizer of claim 1, wherein:

(a) said stabilizer element defining an inner peripheral surface;

(b) said elongate tubular section having a defined diameter and defining a generally cylindrical stabilizer receptacle surface having a diameter less than said defined diameter, said elongate tubular section further defining a plurality of external axially spaced circumferential wear pad seat grooves interrupting said generally cylindrical stabilizer receptacle surface;

(c) a wear resistant low friction lining being fixed about said generally cylindrical stabilizer receptacle surface and being interrupted by said external axially spaced circumferential wear pad grooves; and (d) said plurality of wear pads being disposed within said external axially spaced circumferential wear pad seat grooves and projecting radially beyond said wear resistant low friction lining of said generally cylindrical stabilizer receptacle surface and supporting said stabilizer element with the inner peripheral surface thereof disposed in spaced relation with said wear resistant low friction lining.

12. The non-rotating stabilizer of claim 1, wherein said stabilizer element comprising:

(a) a pair of stabilizer sections each defining bolt holes being positioned for alignment; and (b) a plurality of retainer bolts extending through said bolt holes upon alignment thereof and securing said stabilizer sections in assembly about said wear resistant lining.

13. A non-rotating stabilizer tool for use in well drilling operations, comprising:

(a) an elongate tubular mandrel having an elongate tubular section of a defined diameter and upper and lower drill collars for threaded connection to sections of drill stem making up a drill string for rotation of a drill bit against an earth formation for well drilling, said elongate tubular section defining a stabilizer receptacle surface having a diameter less than said defined diameter and having upper and lower receptacle shoulders located at upper and lower ends of said generally cylindrical stabilizer receptacle surface, said elongate tubular section further defining a plurality of outer peripheral axially spaced wear pad seats interrupting said generally cylindrical stabilizer receptacle surface;

(b) a wear and friction resistant lining being fixed about said generally cylindrical stabilizer receptacle surface and said upper and lower receptacle shoulders and being interrupted by said outer peripheral axially spaced wear pad seats;

(c) a stabilizer element being positioned for rotation about said elongate tubular section and being located within said stabilizer receptacle with portions thereof interposed between said upper and lower receptacle shoulders, said stabilizer element defining external helical lands and grooves to permit flow of returning drilling fluid past said non-rotating stabilizer; and (d) a plurality of circular wear pads being located within said plurality of spaced wear pad seats and being interposed between said elongate tubular section and said stabilizer element and defining low friction rotary support for said stabilizer element and supporting said stabilizer element in spaced relation with said wear and friction resistant lining.

14. The non-rotating stabilizer of claim 13, wherein:

(a) said elongate tubular section defining a stabilizer receptacle having upper and lower receptacle shoulders; and (b) said stabilizer element being located within said stabilizer receptacle with inner peripheral portions thereof interposed between said wear resistant lining of said upper and lower receptacle shoulders.

15. The non-rotating stabilizer of claim 13, wherein:

(a) said stabilizer element defining an inner peripheral surface;

(b) said elongate tubular section having a defined diameter and defining a generally cylindrical stabilizer receptacle surface having a diameter less than said defined diameter, said elongate tubular section further defining a plurality of outer circumferential wear pad seat grooves interrupting said generally cylindrical stabilizer receptacle surface and defining said wear pad seats; and (c) said plurality of wear pads being disposed within said external axially spaced circumferential wear pad seat grooves and projecting radially beyond said generally cylindrical stabilizer receptacle surface and supporting said stabilizer element with the inner peripheral surface thereof disposed in spaced relation with aid wear resistant low friction lining of said cylindrical stabilizer receptacle surface.

* * * * *